US006406021B1

(12) United States Patent
Nadibaidze

(10) Patent No.: US 6,406,021 B1
(45) Date of Patent: Jun. 18, 2002

(54) MASS AMUSEMENT METHOD

(76) Inventor: Tamazi G. Nadibaidze, Zadonsky proezd, d. 16, kor. 1, kv. 378, 115580 Moscow (RU)

( * ) Notice: Subject to any disclaimer, the term of this patent is extended or adjusted under 35 U.S.C. 154(b) by 0 days.

(21) Appl. No.: 09/554,197

(22) PCT Filed: Nov. 5, 1998

(86) PCT No.: PCT/RU98/00365

§ 371 (c)(1),
(2), (4) Date: Jul. 11, 2000

(87) PCT Pub. No.: WO00/29081

PCT Pub. Date: May 25, 2000

(30) Foreign Application Priority Data

Nov. 11, 1997 (RU) ..... 97118622
Nov. 11, 1997 (RU) ..... 97118624
Nov. 11, 1997 (RU) ..... 97118625

(51) Int. Cl.[7] ..... A63F 9/04
(52) U.S. Cl. ..... 273/274; 273/138.1
(58) Field of Search ..... 273/274, 146, 273/142 R, 142 D, 142 E, 142 F, 142 G, 142 H, 142 HA, 138.1

(56) References Cited

U.S. PATENT DOCUMENTS 1,520,697 A * 12/1924 Carlson ..... 273/142 R
4,247,114 A 1/1981 Carroll
4,688,803 A 8/1987 Ollington
4,778,186 A 10/1988 Dudley

FOREIGN PATENT DOCUMENTS

GB 949733 * 2/1964 ..... 273/274
RU 209 02 32 C1 9/1997

OTHER PUBLICATIONS

"The Zodiac Chuck–A–Luck Game", Vincent J. Picataci, Feb. 1974.*

* cited by examiner

*Primary Examiner*—Benjamin H. Layno
(74) *Attorney, Agent, or Firm*—Sughrue Mion, PLLC

(57) ABSTRACT

The method of mass amusement uses a stake field with various-color stake squares with various-color information marks formed thereupon. Also formed is a flat image of the roulette's stationary field with the main and additional sectors, with each main sector to contain, first, the images of different-color information marks similar to those formed at the stake squares of the stake field, and secondly, two images of the hexagonal die with informational marks being various number of spot: from one to six, then, the players place their bets on the stake squares of the stake field, the procedure to be followed by choosing two pairs of random gambling indices with the formed images, beginning from one and ending in six spots.

5 Claims, 3 Drawing Sheets

MASS AMUSEMENT METHOD

FIELD OF THE INVENTION

The invention concerned belongs to methods of social amusement, to be more precisely, it belongs to mass gambling games using dice to throw.

BACKGROUND OF THE INVENTION

A mass amusement method is known, according to which players place their stakes on motley stake zones of the stake field with various-information marks, to be followed by rotating the roulette field with various-color sectors containing the same information marks, to determine the winner based on random occurrence of the playing index i.e. one of the 38 equal-probability numbers (U.S. Pat. No. 4,077,631).

A disadvantage of the known method seems to be rather low amusement value of the method concerned.

Besides, realizing the mass amusement method is known to call for rather sophisticated equipment to provide equal probability of gambling indices to cast. It limits the area of using the known method, i.e., it may be used only in specially equipped premises.

Also known is a mass amusement method taken as the prototype and including the users' placing stakes on motley stake squares of the stake field with formed digital information marks, simultaneous throwing of a pair of dice with equal number of faces, to come to rest at random on a flat surface, scoring the winner based on random casting of two playing indices (U.S. Pat. No. 4,688,803).

A disadvantage of the known method is its rather low amusement value related to unequivocal correspondence of each randomly chosen playing indices with the digital information marks on the stake field.

SUMMARY OF THE INVENTION

The invention is based on the task to increase the entertaining ability of the mass amusement method concerned.

The mission can be accomplished by the fact that the mass amusement method consisting in players' betting on the stake squares of the stake field with motley informational marks formed thereupon, random choice of random indices, based on which the winner is to be scored, according to the invention, an additional flat image of the stationary roulette field is formed to contain 36 main and one or two additional sectors, with each main sector containing random-sequence motley information marks similar to those placed on the stake squares of the stake field, as well as the images of the six-faced die marked with 1 to 6 spots, with the main sectors being divided into six main groups, with the first one containing the first image of the die face with one spot, the second group containing the first image of the die face with two dots, the third—the first image of the die face with three spots, the fourth—the first image of the die face with four spots, the fifth—the first image on the die face with five spots, and the sixth—the first image of the die face with six spots; and the second image of the die face in each group of the main sectors in formed as a sequence of the die face, beginning from the image of the die face with one spot and ending in the image of the face with six dots thereon, is so doing, the random playing indices are chosen by throwing at least one hexahedral die with each face marked starting from one to six spots, and the winner is scored basing on selection of two pairs of random gambling indices.

In doing so, the random playing indices are chosen by casting a hexahedral die four times running, with the first two consecutive throwings forming the first of the 36 possible combinations of the die's face images depicted in the main sectors of the roulette field, while the immediately consequent second two throwings yield the second of the 36 possible combinations of the die's face images.

Besides, random playing indices may be selected by double simultaneous throwing of a pair of hexahedral dice differing in appearance, with the first casting of the pair of dice giving the first of the 36 possible combinations of the dice's face images, depicted in the main sectors of the roulette field, and the immediately consequent second simultaneous throwing giving the second of the 36 possible combinations of the die's face images.

Another preferred example determines the random gambling indices are chosen by means of simultaneous throwing of four hexahedral dice differing in appearance; in so doing, by the previously chosen pair of dice they determine the first of the 36 possible combinations of the die's faces images depicted in the main sectors of the roulette field, and the remaining pair of dice determines the second of the 36 possible combinations of the die's faces images.

It seems advisable to form additional sectors of the roulette field by depicting digital information marks "0" or "0" and "00".

The advantage of the method proposed is that owing to the added formation of the flat image of the stationary roulette field with the man and additional sectors, formation in each sectors of two types of images (motley information marks and two images of the die's face), as well as using as a means of choice two random gambling indices of at least one hexahedral die with varying number of spots, will complicate the process of determining the winner and, thus, increasing the amusement value of the method.

BRIEF DESCRIPTION OF DRAWINGS

Following are drawings to explain the method, where.

DETAILED DESCRIPTION OF THE INVENTION

Figure 1:
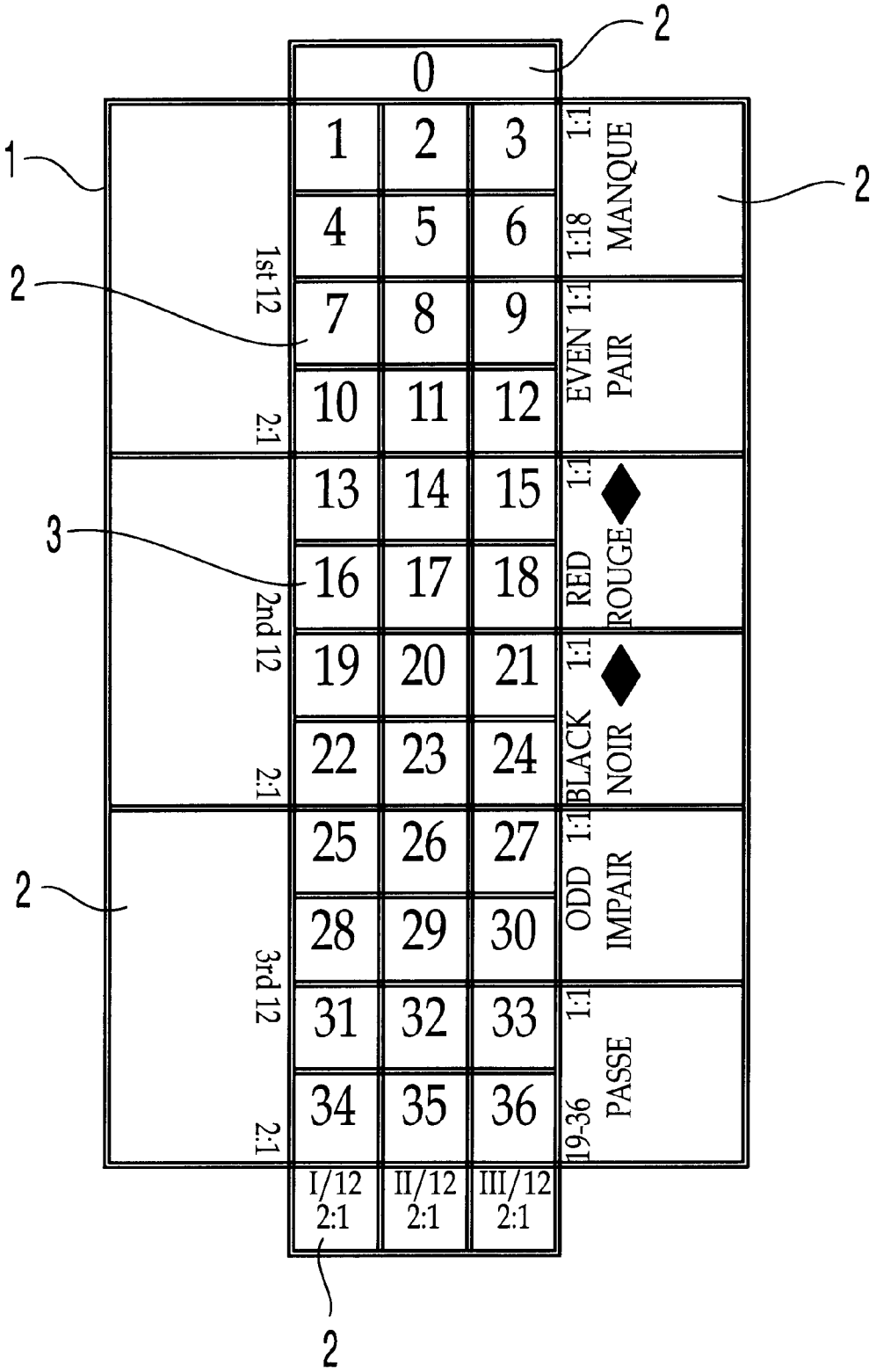
FIG. 1 depicts the stake field.
Figure 2:
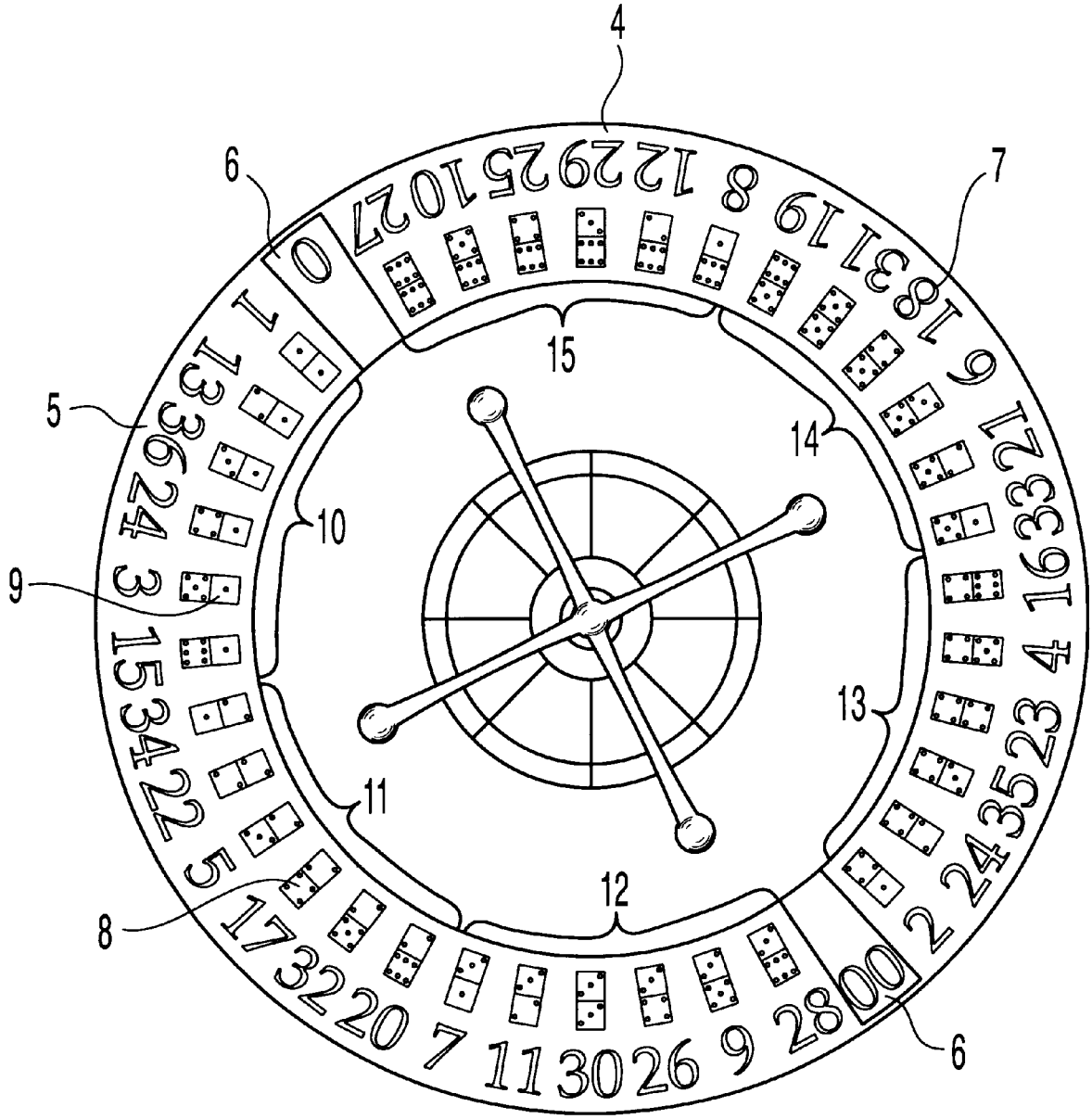
FIG. 2 depicts the roulette field.
Figure 3:
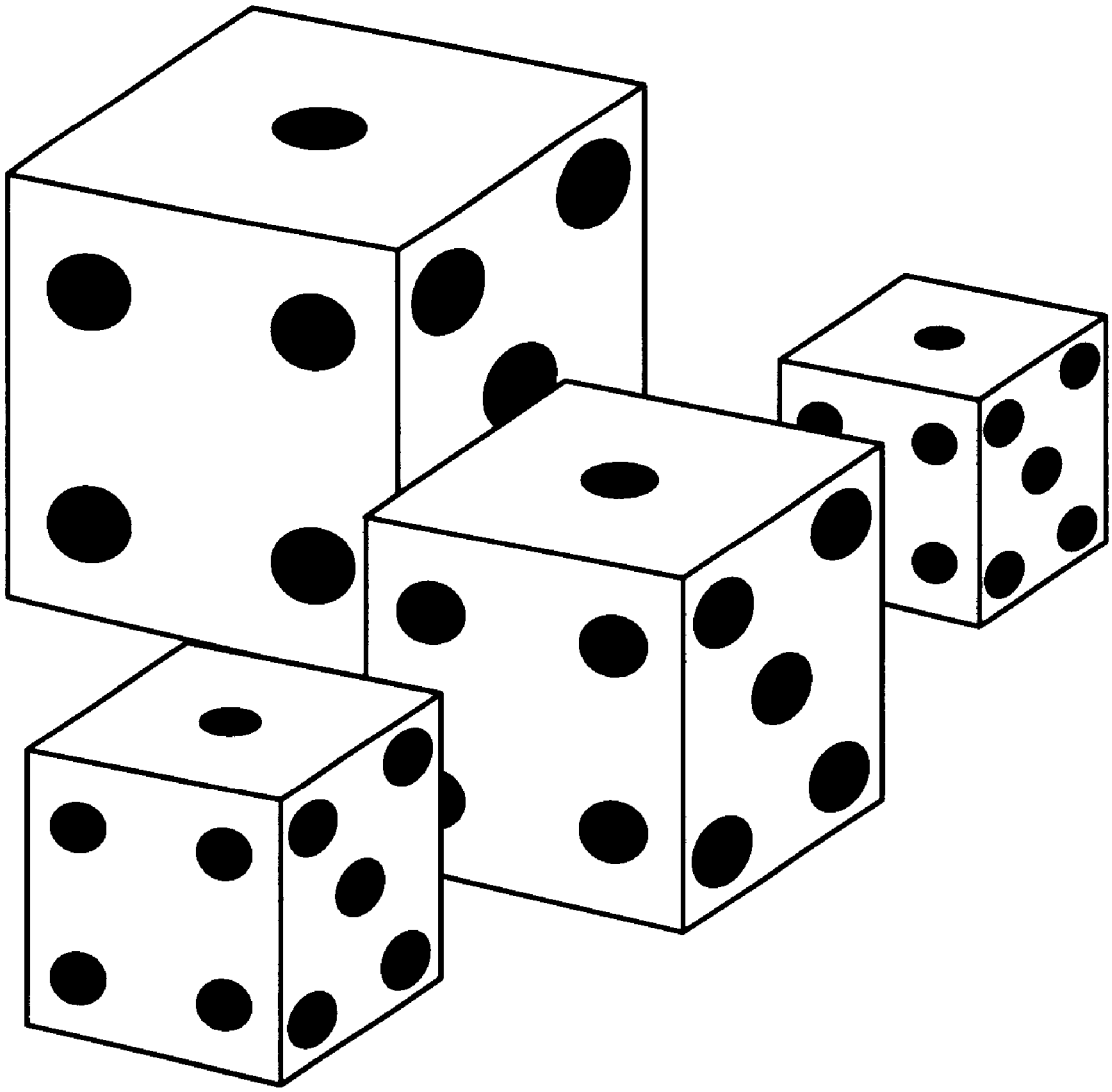
FIG. 3 depicts four hexahedral dice.

1.—stake field.
2.—stake field squares.
3.—digital information marks.
4.—roulette field.
5.—main sectors of the roulette field.
6.—additional sectors of the roulette field.
7.—digital information marks.
8.—first image of the die's face.
9.—second image of the die's face.
10, 11, 12, 13, 14, 15—groups of the roulette field main sectors.

Options of Implementing the Method.

Performing the proposed method of mass entertainment is accompanied by observing the demands similar to those imposed by carrying out the measures relating to the roulette playing, i.e., provision of equal probability of the numbers to be cast (gambling indices).

Prior to implementing the method, the croupier chooses the "casino's number" (any number from 1 to 36). Choosing the "casino's number" may be done randomly, or by using any means of choice of a random number from a plurality of equal-probability numbers. Then, the stake field (1) is formed with motley stake squares (2) with various-color information marks (3), e.g., digits from 1 to 36.

Additionally, a flat image of the stationary roulette field is formed (4) to contain 36 main (5) and one or two additional (6) sectors. Each main sector (5) of the roulette field (4) is to contain a random-sequence various-color information marks (7), for example the digits similar to the information marks (3) formed on the stake squares (2) of the stake field (1). Additionally, each main sector (5) of the roulette field (4) is to contain two images (8, 9) of the hexahedral die with information marks as various number of spots, and the main sectors (5) of the roulette field (4) are divided into six similar groups (10, 11, 12, 13, 14 and 15). The first group (10) contains the first image (8) of the die's face with one spot, group two (11) contains the first image of the die's face with two spots, group three (12) contains the first image of the die's face with three spots, etc. The second images (9) of the die's face to be formed in each group of the main sectors (5) of the roulette field (4) are to represent a sequence (row) of the die's six faces with the face's image beginning from the image of one spot and ending by the image of the die's face with six spots.

Formation of the additional sector (6) "0" of the flat stationary roulette field (4) is designed for bets to be made for the European roulette, and the additional sectors "0" and "00"— for bets to be made for the American roulette.

After the above-described operations, the players place their bets on the stake squares (2) of the stake field (1) with motley information marks (3) formed thereupon.

Then, the croupier carries out selection of two pairs of random gambling indices, for example, by the following method.

A hexahedral die marked with one-to-six spots is herein to be thrown four times running, with the first two consecutive castings of the die yielding the first of the 36 possible combinations of images on the die's faces, depicted in the main sectors of the roulette field, and the immediately consequent after the first two castings of the same die next two castings yielding the second of the 36 possible combinations on the die's faces images.

The two pairs of random gambling indices may also be chosen by means of two hexahedral dice. However, in this case the dice must differ either in size, color, or otherwise. In this case, the two dice are simultaneously cast two times running. In so doing, prior to the first casting, both the croupier, and the players must agree as to which of the die would refer to a particular sequence of the hexahedral die face's images formed in each main sector (5) of the flat stationary roulette field (4). Resulting therefrom, the first simultaneous throwing of the two dice is to yield the first of the 36 possible combinations of the dice's faces images formed in the main sectors of the roulette field, and the immediately following simultaneous casting of the same dice is to yield the second of the 36 combinations of the dice faces images.

A third variant is also possible to choose the two pairs of random gambling indices.

In this case, four hexahedral dice are used, which differ either in color, arrangement, or size, etc. Like in the previous option, the croupier and the players must agree upon dividing the dice, firstly, into the pairs, and, secondly, on dividing each of the pairs of dice into the first and the second according to the images of the die's face in the first or the second rows of images formed in each group of the main sectors of the roulette field. The croupier casts the four dice simultaneously, with the first previously chosen pair of dice yielding the first of the 36 possible combinations of the dice faces images formed in the main sectors of the roulette field, and the remaining pair yielding the second of the of the 36 possible combinations of the dice faces images.

Based on the results of casting one of the dice or several dice, the winner is determined, for example, as follows.

If the first throwing has showed any number except the "casino's number", the second throwing will show the prize number for the players.

If selecting the first pair of random gambling indices has showed the "casino's number", and the second yielded any number except the "casino's number", the winners would be those players having made their stakes to "0", and the stakes related thereto (0-1, 0-2, 0-3, etc.).

If the first and the second pairs of the chosen random gambling indices yielded the "casino's number", replaying is to be followed.

In case of the American option with the "0" and "00" stakes, two numbers of the casino are to be determined. Then, if the first pair of the random gambling indices chosen yields any number except the "casino's numbers", the second pair of the random gambling indices will show the winning number for the players.

If the first pair of the chosen random gambling indices yields the first "casino's number", and selecting the second pair yields any number except the "casino's numbers", the winners would be those players having bet on "0".

If the first pair of the chosen random gambling indices yields the second "casino's number", and selecting the second pair yields any number except the "casino's numbers", the winners would be those players having bet on "00".

If selecting the first and the second pairs of random gambling indices resulted in the "casino's number" (any), replaying is to be followed. A stake "F" ("fortune") might be proposed, which will win if only two "casino's numbers" have been cast in succession.

Industrial Applicability

The proposed method of social amusement can be used in both specially equipped premises, and in usual ones. In other words, it may successfully be referred to both the in-, and out-of-door games.

What is claimed is:

1. A method of playing a mass amusement game comprising the steps of:

providing at least one hexahedral die with faces marked with one to six dots;

providing a betting field comprising thirty six stake squares, and one or two additional stake squares distinguishable from the thirty-six stake squares, each stake square having a different digital informational mark distinguishing each of the thirty-six stake squares, using individual numbers from 1 to 36, red or black color, said one or two additional stake squares also having a different digital informational mark distinguishing each of the additional stake squares, using mark 0 for the stakes for European roulette or marks 0 and 00 for the stakes for American roulette, providing a flat image of a stationary roulette wheel comprising thirty-six main sectors, and one or two additional sectors all positioned to form a circle around the periphery of the roulette wheel, each of the thirty-six main sectors having a different mark corresponding to the informational marks placed on the thirty-six stake squares, and each additional sector having a different mark corresponding to marks placed on the additional stake squares, each of the thirty-six main sectors also including two images of the face of the die marked from one to six dots, the thirty-six main sectors divided into six similar groups, a first group of six main sectors containing the first image of the die face with one dot, the second group of six main sectors containing the first image of the die face with two dots, the third group of six main sectors containing the first image of the die face with three dots, the fourth group of six main sectors containing the first image of the die face with four dots, the fifth group of six main sector containing the first image of the die face with five dots, the sixth group of six main sectors containing the first image of the die face with six dots; and the second image of the die face in each group of six main sectors formed as a sequence of the die faces, beginning from the image of the die face with one dot and ending in the image of the die face with six dots, wherein each of the thirty-six main sectors depicting two images of die faces representing one of the thirty-six possible combinations of two images dice faces, wherein all thirty-six possible combinations of two images dice faces are depicted on the roulette wheel;

the croupier having chosen one or two casino's numbers from 1 to 36, one casino's number for the stakes for the European roulette and two casino's numbers for the stakes for the American roulette, the choice of the casino's numbers is to be made at random;

each player placing bets on selected stake squares;

rolling the hexahedral die a sufficient number of time to yield a first combination of two images of dice faces, and a second combination of two images of dice faces;

determining a winner in case of the European roulette: if the yielded said first combination points on corresponding, depicted on the main sectors on the roulette field number except the casino's number, the second said combination would point through the said second combination to the corresponding with it winning number for the players; if the first rolling has yielded through the said first combination the corresponding number equal to the casino's number, and the second rolling yielded any number except the casino's number, the winners would be those players having made their stakes to 0; if said first and second combinations point the number to equal to casino's number, replaying is to be followed;

determining a winner in case of the American roulette: if the first rolling has yielded the said first combination and corresponding with it any number except two casino's numbers, the second rolling would point through the said second combination to the corresponding with it winning number for the players; if the first rolling has yielded through the said first combination the corresponding number equal to the first of the two casino's number, and the second rolling yielded any number except the casino's number, the winners-would be those players having made their stakes to 0; if the first rolling has yielded through the said first combination the corresponding number equal to the second of the two casino's number, and the second rolling yielded any number except the casino's number, the winners would be those players having made their stakes to 00; if the said first and second combinations point the number equal to any of two casino's number, replaying is to be followed or a stake F—fortune might be proposed if only two numbers equal to casino's numbers have been cast in succession.

2. Method according to claim 1, differing in that the random gambling indices are chosen by casting a hexahedral die four times running, with the first two consecutive castings of the die yielding the first of the 36 possible combinations of images on the die's faces, depicted in the main sectors of the roulette field, and the immediately consequent after the first two castings of the same die next two castings yielding the second of the 36 possible combinations on the dice's faces.

3. Method according to claim 1, differing in that the random gambling indices are chosen by double simultaneous casting of two hexahedral dice differing in appearance, with the first simultaneous throwing of the two dice yielding the first of the 36 possible combinations of the die's face images formed in the main sectors of the roulette field, and the immediately following simultaneous casting of the same dice yielding the second of the 36 combinations of the dice faces images.

4. Method according to claim 1, differing in that the random gambling indices are chosen by double simultaneous casting of four hexahedral dice differing in appearance, with the first previously chosen pair of dice yielding the first of the 36 possible combinations of the dice faces images formed in the main sectors of the roulette field, and the remaining pair yielding the second of the 36 possible combinations of the dice faces images.

5. Method according to claim 1, differing in that the additional sectors of the roulette field are formed by depicting digital information marks 0 or 0 and 00.

* * * * *